United States Patent [19]

Johnson

[11] 4,345,436

[45] Aug. 24, 1982

[54] CONTROL FOR LOAD SHARING PUMPS

[75] Inventor: Howard L. Johnson, Joliet, Ill.

[73] Assignee: Caterpillar Tractor Co., Peoria, Ill.

[21] Appl. No.: 245,238

[22] PCT Filed: Apr. 7, 1980

[86] PCT No.: PCT/US80/00379

§ 371 Date: Apr. 7, 1980

§ 102(e) Date: Apr. 7, 1980

[87] PCT Pub. No.: WO81/02914

PCT Pub. Date: Oct. 15, 1981

[51] Int. Cl.[3] ..... F15B 11/16; F15B 13/06; F15B 13/09

[52] U.S. Cl. ..... 60/421; 60/422; 60/428; 60/430; 91/529; 91/530

[58] Field of Search ..... 60/420, 421, 422, 428, 60/430, 484, 486; 91/529, 530; 137/596.13

[56] References Cited

U.S. PATENT DOCUMENTS

| | | | |
|---|---|---|---|
| 3,693,506 | 9/1972 | McMillen et al. | 91/448 |
| 3,987,623 | 10/1976 | Bianchetta | 60/422 |
| 3,991,571 | 11/1976 | Johnson | 60/422 |
| 3,998,053 | 12/1976 | Johnson | 60/422 |
| 4,112,821 | 9/1978 | Bianchetta | 60/486 |
| 4,210,061 | 7/1980 | Bianchetta | 60/484 |

OTHER PUBLICATIONS

Borg Warner Pressure Compensated Directional Control Valves Brochure #HDS 75-1.

*Primary Examiner*—Irwin C. Cohen
*Attorney, Agent, or Firm*—Phillips, Moore, Weissenberger, Lempio & Majestic

[57] ABSTRACT

Conditional exchanging of working fluid between plural fluid circuits (13A, 13B) having separate supply pumps (18A, 18B) is provided for without continuously bleeding fluid from the pump control pressure lines (21A, 21B). Each circuit (13A, 13B) has a pump control (19A, 19B) responsive to a control pressure, a plurality of fluid motors (14A, 15A, 16A, 14B, 15B, 16B), and a group of resolver valves (38A, 38B) which compare motor pressures and intercommunicate the pump control (19A, 19B) with the most highly pressurized motor (14A, 15A, 16A, 14B, 15B, 16B). At times when fluid from one circuit (13A, 13B) is being delivered to a motor (16A, 16B) of another circuit (13A, 13B), the pressure comparing function of the resolver group (38A, 38B) of the one circuit (13A, 13B) is extended to include the motor (16A, 16B) of the other circuit (13A, 13B). Among other uses, the system (11) may be used on excavator vehicles having plural fluid motors performing a variety of different functions. Absence of a bleed in the pump control lines (21A, 21B) conserves power and enables precise response of the pumps to demand changes.

12 Claims, 3 Drawing Figures

PUMP CONTROL
MOTOR CONTROL VALVE
PILOT VALVE
FLOW CONTROL VALVE
-P

CONTROL FOR LOAD SHARING PUMPS

DESCRIPTION

1. Technical Field

This invention relates generally to fluid systems having a plurality of pumps for supplying working fluid to a plurality of fluid circuits. More particularly the invention relates to the control and coordination of variable output fluid sources in systems where pump output that is not being used by an associated circuit is made available to another circuit served by another pump.

2. Background Art

Fluid driven devices, such as rotary or reciprocating fluid motors for example, are often operated intermittently, at variable speeds, with variable loading or under some combination of these conditions. Demand for working fluid is therefore variable with respect to both pressure and flow.

Greater efficiency is realized under these conditions if the source of working fluid is controlled so that output pressure and preferably output flow as well varies in accordance with demand. Otherwise, the fluid source must be operated to continually provide a high output pressure and high flow adequate to meet the peak demands of the driven devices. During periods when the demand is below maximum, the fluid source needlessly consumes power and needlessly contributes to heating and aeration of the working fluid.

It is a known practice to avoid these problems by feeding back a pressure signal from the driven device to a control which adjusts the output pressure of the fluid source to match variations in demand and which in some cases adjusts output flow as well.

Fluid source control of this kind is subject to a complication in systems in which a pump supplies fluid to a plurality of devices. At any given time, the feedback signal or control pressure should correspond to the pressure within the one of the several devices which is most highly pressurized and different ones of the devices may become the most highly pressurized one at different stages of operation. Consequently the control system must compare the pressures within each of the devices and transmit the highest pressure to the pump control.

One known form of pump control for this purpose uses a network of resolver valves to compare pressures from several fluid driven devices in order to communicate the most highly pressurized device, at any given time, with the fluid source control.

Pump output control by feedback of a control pressure from a driven device becomes still more complex in fluid systems that have more than one pump each supplying an associated separate circuit of fluid driven devices and which also have fluid exchanging arrangements which make fluid from one pump available to supplement another pump when the pumping capacity of the one pump is not being fully used by its own circuit. In such a system, the pressure comparing function of the pump control of the one circuit must be temporarily extended to include a pressure from another circuit during periods when fluid transfer is occurring.

To accomplish the conditional comparison of pressures from devices served by separate fluid sources without intercommunicating such devices, prior fluid source controls for systems of this kind include check valves or the like in the control pressure lines between the fluid source control and the several devices. Thus the control pressure is transmitted to the fluid source control through a one way flow path. Consequently pressure increases from the most highly pressurized device are directly transmitted to the fluid source control but pressure decreases are not. To cause the control pressure to decrease when the pressure at the most highly pressurized device decreases, it has heretofore been necessary to provide a continually open bleed orifice in the control pressure line. This allows the control pressure to drop following a decrease in pressure within the most highly pressurized device since, owing to the bleed, a continual input of fluid from that device, through the check valve, is needed to maintain the control signal pressure at any given level.

A continual bleeding or draining of fluid from the fluid source control pressure line has several undesirable effects. For example, the continual loss of working fluid which occurs at such bleed orifices can be substantial particularly in high pressure systems. This discharging of pressurized fluid back to drain through the orifice wastes a substantial amount of power, and consequently the power source and pumps must be of higher capacity than would otherwise be necessary. Flow lines and other components of the system may necessarily be larger than would otherwise be the case.

The present invention is directed to overcoming one or more of the problems as set forth above.

DISCLOSURE OF THE INVENTION

In one aspect of the present invention, a fluid system has first and second pluralities of fluid operated devices and first and second fluid source means for supplying fluid to the first and second pluralities of devices respectively. The system also has first and second control means for varying the outputs of the first and second fluid sources in response to control pressures and crossover means for transmitting fluid from the first source to at least one of the second plurality of devices. The system is further provided with pressure comparing means for establishing a two way control pressure path between the first control means and the one of a predetermined group of the devices that is most highly pressurized at a particular time, the predetermined group including the first plurality of devices and at least one of the second plurality of devices.

In another aspect of the present invention in which the crossover means also transmits fluid from the second source to at least one of the first plurality of devices, second pressure comparing means are provided for establishing a two way control pressure flow path between the second control pressure means and the one of a second predetermined group of the devices that is most highly pressurized at a particular time. The second predetermined group includes the second plurality of devices and at least one of the first plurality of devices.

The invention precisely varies pump output pressure, and preferably output flow as well, to match the requirements of the most heavily loaded one of an associated group of devices under conditions where the associated group of devices may at times be extended to include one of another group of devices having another supply pump. The invention does not require a continuous bleed of fluid from the pump control pressure line. Consequently, power savings are realized and, at least in some cases, pumps, fluid lines and other components of reduced capacity or size may be used in certain parts of the system. As a two way or reversible pump control pressure flow path is provided, the pump responds more precisely to pressure demand variations than is the case where bleed orifices are needed in order to respond to decreasing pressures in the devices supplied by a pump.

BEST MODE FOR CARRYING OUT THE INVENTION

Figure 1:
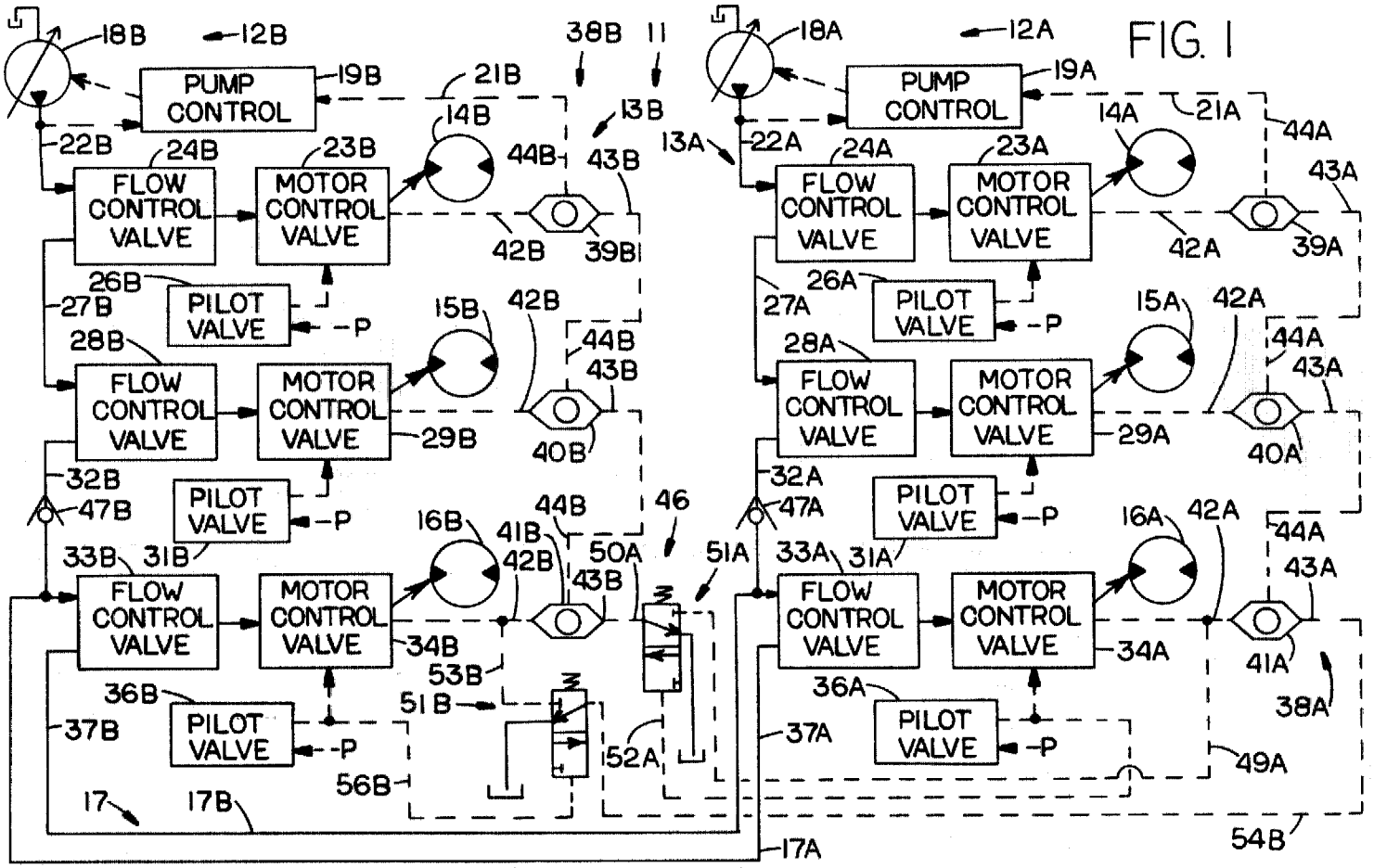
FIG. 1 is a schematic depiction of a plural circuit, plural pump fluid system including an embodiment of the present invention.

Referring initially to FIG. 1 a fluid system 11 embodying aspects of the invention is initially depicted in schematic form to best illustrate certain significant features of the invention. Examples of suitable more detailed constructions for portions of the system 11 will be hereinafter described.

The invention is adaptable to a variety of different specific fluid systems 11 of the general type which have a plurality of fluid sources 12A and 12B each primarily supplying pressurized fluid to an associated one of a plurality of fluid circuits 13A and 13B and in which each of the circuits 13A and 13B includes a plurality of fluid operated devices such as fluid motors 14A, 15A and 16A of the first circuit 13A and motors 14B, 15B and 16B of the second circuit 13B in this particular example. Fluid systems 11 of the type to which the invention is applicable are further characterized by load sharing or crossover means 17 for making working fluid which is not being utilized by one of the circuits 13A, 13B available to the other circuit to supplement the output of the fluid source 12A, 12B of the other circuit.

For purposes of example the fluid system 11 depicted in FIG. 1 is of the type used in a hydraulic excavator vehicle of the form described in U.S. Pat. No. 3,987,623 issued to Donald L. Bianchetta and dated Oct. 26, 1976. In this context, fluid motor 14A drives the right crawler track of the vehicle, fluid motor 15A pivots the bucket and fluid motor 16A raises and lowers the boom of the excavator. Fluid motor 14B drives the left side crawler track, motor 15B swings the boom horizontally and motor 16B pivots the stick of the excavator.

The devices or motors 14A, 15A and 16A of first circuit 13A are supplied with working fluid by the first fluid source 12A which in this example includes a first variable displacement pump 18A. Pump 18A is provided with first control means 19A for varying the pump output in response to variations of a first control pressure received through a first control pressure line 21A. Control means 19A, which may be of known construction, increases or decreases the displacement of pump 18A in response to decreases and increases respectively of the control pressure in line 21A to vary both the pump output pressure and output flow in response to variations in demand for working fluid. Alternately, the fluid source 12A may be of the other known type which employs a constant displacement pump and in which the control means 19A is a modulated relief valve that diverts a portion of the pump output flow back to tank to the extent necessary to vary output pressure in accordance with variations of the control pressure. A variable displacement pump 18A as used in this example is often preferable since it matches output flow as well as output pressure with demand changes. Power savings are realized as little, if any, working fluid is discharged to tank prior to being utilized by a motor.

The first fluid circuit 13A as depicted in FIG. 1 is of the priority form in which working fluid from source 12A is made available to the motors 14A, 15A and 16A in sequence with the requirements of initial motor 14A taking precedence over those of motors 15A and 16A and in which the requirements of motor 15A in turn take precedence over the requirements of the final motor 16A. For this purpose an output line 22A of pump 18A is connected to a motor control valve 23A of the initial motor 14A through a flow control valve 24A.

Motor control valve 23A, which will hereinafter be described in more detail, is operated by a pilot pressure received from a manually actuated pilot valve 26A and controls fluid flow to motor 14A to start, stop and reverse the motor and to control motor speed.

Flow control valve 24A, which will also be hereinafter described in more detail, maintains a constant flow of fluid to motor 14A, as selected by the setting of motor control valve 23A, if pressure variations occur within the pump output line 22A. Flow control valve 24A also delivers working fluid which is not needed by motor 14A to a bypass line 27A.

The second motor 15A is operated by working fluid received from bypass line 27A through another flow control valve 28A and another motor control valve 29A which is operated by pilot pressures from another manual pilot valve 31A. The bypass line 32A of flow control valve 28A delivers fluid to still another flow control valve 33A which may in turn transmit such fluid to the final motor 16A through another motor control valve 34A responsive to pilot pressures from another manually operated pilot valve 36A. The bypass line 37A of the final flow control valve 33A connects with the first crossover line 17A of crossover means 17 which will be hereinafter described in more detail.

Aside from the different functions served by the three motors 14B, 15B and 16B, the second fluid circuit 13B is essentially similar to the first circuit 13A as described above and has similar components which are designated in FIG. 1 by similar reference numerals followed by the letter B instead of the letter A. Thus a second variable displacement pump 18B having second control means 19B responsive to a second control pressure in a second control signal line 21B may supply fluid to motors 14B, 15B and 16B through a second set of components similar to those previously described. A bypass line 37B of the final flow control valve 33B of second fluid circuit 13B connects with a second crossover line 17B.

Thus in either of the two circuits 13A and 13B, motors 14A, 14B, 15A, 15B, 16A and 16B may be operated singly or at the same time. Considering first circuit 13A for example, owing to the starting and stopping of the several motors at different times and the load variations which may be experienced by each of the motors the demand for working fluid of the circuit 13A as a whole, both with respect to pressure and flow, is variable. To control the output of pump 18A to match demand variations, a fluid pressure is fed back to control pressure line 21A and is caused to vary in accordance with variations of pressure in the particular one of the motors 14A, 15A and 16A which is the most highly pressurized one at any given time.

In particular, first pressure comparing or resolving means 38A are provided for establishing a two way control pressure flow path between control pressure line 21A and the most highly pressurized one of motors 14A, 15A and 16A. Pressure comparing means 38A includes a first plurality of resolver valves 39A, 40A and 41A each being of the type which has a pair of inlet passages 42A and 43A and an outlet passage 44A and which maintains the outlet passage 44A in communication with the most highly pressurized inlet passage 42A or 43A while sealing off the other inlet passsage. First inlet passages 42A of resolver valves 39A, 40A and 41A are connected to motors 14A, 15A and 16A respectively, during operation of the associated motor, through motor control valves 23A, 29A and 34A respectively. The second inlet passage 43A of the initial resolver valve 39A is connected to the outlet 44A of the succeeding resolver valve 40A which in turn has the second inlet passage 43A connected with the outlet passage 44A of the final resolver valve 41A. The outlet passage 44A of the initial resolver valve 39A is connected with the control pressure signal line 21A while the second inlet passage 43A of the final resolver valve 41A connects with resolver control means 46 to be hereinafter described in more detail.

Second, essentially similar pressure comparing means, 38B, including additional resolver valves 39B, 40B and 41B, are provided in the second fluid circuit 13B, elements of the second pressure comparing means being designated in the drawings by reference numerals corresponding to the reference numerals of the corresponding element of the first fluid circuit 13A but which are followed by the letter B instead of the letter A.

Crossover means 17 enables working fluid from first source 12A, that is not required by any of the devices of the first circuit 13A to be delivered to at least one device or motor 16B of the second circuit 13B if it is needed by the second circuit motor at that time. In this example, crossover means 17 also enables the transmitting of fluid that is not required by the devices of the second circuit 13B to at least one device 16A of the first circuit 13A. Thus either pump 18A and 18B may assist the other at times when the full output of a particular pump is not being used by the associated fluid circuit 13A or 13B. This enables more productive use of the available pumping capacity.

In the hydraulic excavator vehicle example of this embodiment the boom motor 16A of the first circuit 13A and the stick motor 16B of the second circuit 13B are the particular devices most likely to experience the highest working fluid demand. Accordingly the crossover means 17 make surplus fluid from first circuit 13A available to the stick motor 16B only of the second circuit 13B and makes surplus fluid from second circuit 13B available to the boom motor 16A only of the first circuit. In other usages of the invention the fluid supplementing arrangement may be extended to include others of the devices of each circuit 13A and 13B by adding one or more resolver valves to means 38A and 38B.

In the present example crossover means 17 includes a check valve 47A in bypass line 32A of the first circuit 13A, the check valve being oriented to block flow towards flow control valve 28A. A check valve 47B is similarly situated in bypass line 32B of the second fluid circuit 13B.

The first crossover flow line 17A connects bypass line 37A of first circuit 13A with the portion of bypass line 32B of second circuit 13B which is between check valve 47B and flow control valve 33B. Similarly the second crossover flow line 17B interconnects bypass line 37B of second circuit 13B with bypass line 32A of the first circuit at a point between check valve 47A and the final flow control valve 33A.

During periods when working fluid not needed by first circuit 13A is being transmitted to second circuit 13B, the pressure comparing function performed by resolver valves 39A, 40A and 41A of the first circuit is extended to include the pressure from the motor 16B of the second circuit to which the surplus fluid is being made available. This assures that the control pressure transmitted to first pump control 19A of the first circuit 13A is always indicative of pressure at the most highly pressurized device currently being supplied with working fluid by that pump. Similarly, second circuit pump control 19B may respond to a pressure from the first circuit 13A when working fluid from the second circuit is being supplied to first circuit.

Resolver control means 46 for this purpose includes first and second resolver control valves 51A and 51B. First resolver control valve 51A is a two position pilot operated valve which is spring biased to a normal position at which the valve closes a pressure transmitting line 49A connected to first inlet passage 42A of the final resolver valve 41A of first circuit 13A while venting another pressure transmitting line 50A which connects with second inlet passage 43B of the final resolver valve 41B of the second circuit 13B. A pilot line 52A of first resolver control valve 51A is communicated with pilot valve 36A and is pressurized at the same time that motor control valve 34A of the first circuit is opened to operate motor 16A in a predetermined direction of motor operation, the predetermined direction being the boom raising mode of motor operation in this hydraulic excavator vehicle example.

Pressurization of pilot line 52A shifts valve 51A to an alternate position at which pressure transmitting lines 49A and 50A are communicated with each other.

Second resolver control valve 51B is a similar two position valve spring biased to a normal position at which a pressure transmitting line 53B, connected to first inlet passage 42B of the final resolver valve 41B of the second circuit 13B, is closed while a line 54B to the second inlet passage 43A of the final resolver valve 41A of the first circuit is vented. Pilot line 56B of second resolver control valve 51B communicates with pilot valve 36B of second circuit 13B and is pressurized when the motor control valve 34B is opened to operate motor 16B in one of the two directions of motor operation, specifically the stick advancing direction of motor operation in this hydraulic excavator vehicle example of the invention. Pressurization of pilot line 56B shifts second resolver control valve 51B to the alternate position at which pressure transmitting lines 53B and 54B are intercommunicated.

Figure 2:
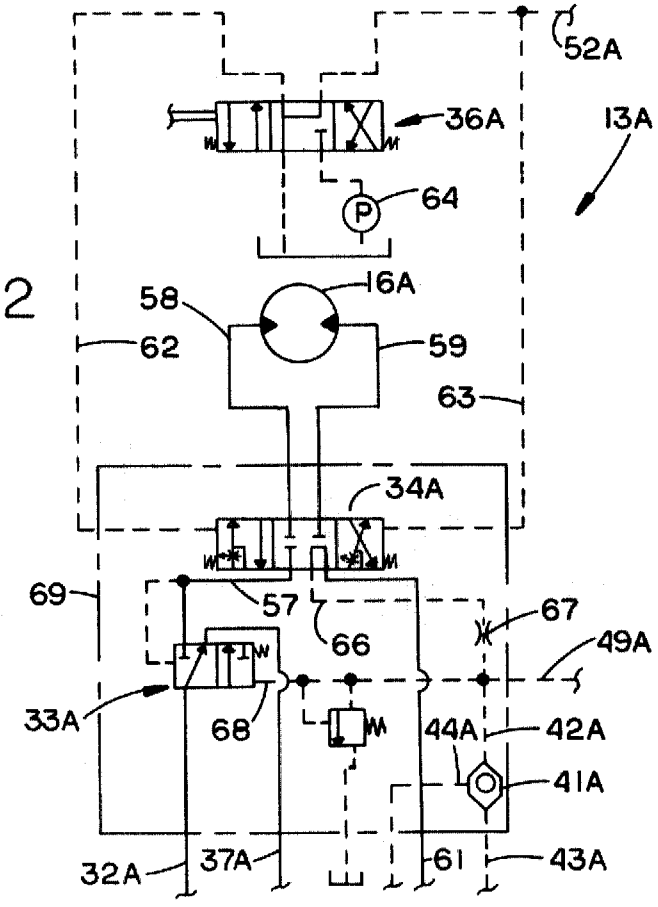
FIG. 2 is a fluid circuit diagram further illustrating a portion of the system of FIG. 1.

To best illustrate basic aspects of the fluid system 11, certain components are depicted in FIG. 1 by means of generalized symbols and as being interconnected by single fluid flow lines which as a practical matter would provide only for one way operation of the several motors 14A, 15A, 16A, 14B, 15B and 16B. In most usages of the invention two way or reversible motor operation is needed. FIG. 2 schematically depicts suitable detail for the flow control valve 33A, motor control valve 34A, pilot valve 36A, resolver valve 41A and interconnections and associated components, for controlling motor 16A in particular. Essentially similar detailed interconnections may be utilized to control each of the other motors 14A, 15A, 14B, 15B and 16B of the fluid circuits 13A and 13B of FIG. 1.

Referring to FIG. 2, flow control valve 33A receives working fluid through the previously described bypass line 32A and is spring biased towards a position at which the bypass line 32A is communicated with the fluid supply line 57 to motor control valve 34A. Motor control valve 34A is a three position pilot operated valve spring biased to a centered position at which lines 58 and 59 to the associated motor 16A are closed but which may be operated to deliver fluid to either of such lines while communicating the other with a drain line 61. The motor control valve 34A is operated by shifting a manual pilot valve 36A which is supplied with pilot pressure from a suitable source 64. Upon being shifted in either direction from the centered position, pilot valve 36A selectively pressurizes pilot line 62 or pilot line 63 to controllably shift motor control valve 34A. Pressurization of pilot line 63 in particular also pressurizes the pilot line 52A of the first resolver control valve 51A of FIG. 1, as line 52A is connected to line 63.

Referring again to FIG. 2, a signal line 66 connects to motor control valve 34A to receive a pressure corresponding to that being supplied to motor drive line 58 or 59 except when the control valve is at the centered position, the signal line being vented to drain line 61 at the centered position of the control valve. Signal line 66 also connects to first inlet 42A of the previously described resolver valve 41A through a flow orifice 67 and thus delivers a control pressure to resolver valve 41A that is indicative of the pressure in motor 16A. This control pressure is delivered to outlet 44A of the previously described resolver valve 41A except when another control pressure received at the other inlet passage 43A of resolver valve 41A is greater.

Signal line 66 also communicates with one pilot line 68 of flow control valve 33A, the opposite pilot line 69 being connected to fluid supply 57.

Figure 3:
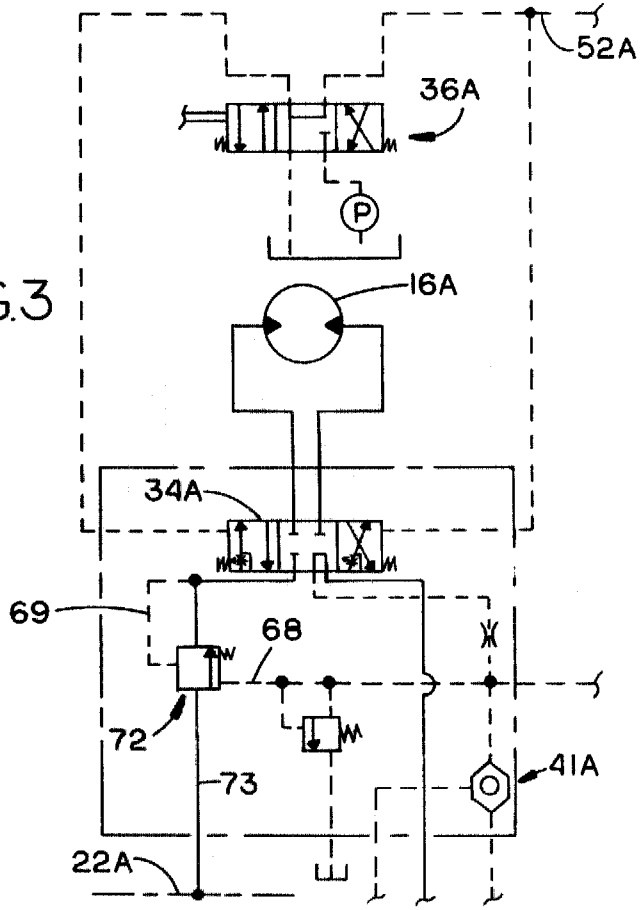
FIG. 3 is a fluid circuit diagram illustrating an alternate embodiment of the portion of the system shown in FIG. 2.

The fluid circuits 13A and 13B as hereinbefore described with reference to FIGS. 1 and 2 provide a priority system in which working fluid is made available to the several motors of each circuit in sequence and thus the fluid requirements of a given one of the motors of either circuit take precedence over subsequent ones of the motors of the same circuit. In FIG. 2, the flow control valve 33A transmits working fluid to outgoing bypass line 37A only to the extent that such fluid is not needed to fully meet the requirements of motor 16A as determined by the operator's adjustment of pilot valve 36A. The invention is also adaptable to parallel systems in which the available supply of working fluid of either circuit 13A or 13B is made equally available to all motors of that circuit. As illustrated in FIG. 3 this may be accomplished by utilizing a modified form of flow control valve 72.

In the parallel system modification of FIG. 3, a fluid input line 73 to all flow control valves, such as valve 72, of a given circuit 13A is communicated directly with the pump output line 22A of the circuit. The flow control valve 72 in this embodiment is of the known two way form as it need not perform a bypass function as in the previously described example. All other portions of the circuit as depicted in FIG. 3 may be similar to the previously described circuit of FIG. 2.

INDUSTRIAL APPLICABILITY

The invention has been described above and depicted in the drawings in the context of the fluid system 11 for controlling a plurality of motors 14A, 15A, 16A, 14B, 15B and 16B on a hydraulic excavator vehicle. It should be understood that the invention is equally adaptable to many other fluid systems having plural motors or other fluid actuated devices which exhibit a variable demand for fluid and which have a plurality of pumps for supplying the working fluid.

With reference to FIG. 2, the operator initiates operation of a selected one of the motors such as motor 16A by shifting the associated pilot valve 36A to supply pilot fluid to the associated motor control valve 34A. This shifts the motor control valve 34A to supply fluid under pressure to one drive line 58 or 59 of the motor 16A while venting the other motor drive line to drain line 61. Motor 16A thus operates at a speed determined by the degree to which the operator has shifted pilot valve 36A. Signal line 66 communicates the pressurized one of the motor supply lines 58 and 59 with resolver valve 41A through orifice 67. During this operation of the motor 16A, flow control valve 33A self-adjusts as necessary, in the known manner, to maintain a constant flow through motor control valve 34A as selected by the adjustment of pilot valve 36A and thus maintains a constant selected motor speed notwithstanding variations in loading of the motor which may occur.

The modified fluid circuit of FIG. 3 operates in an essentially similar manner in response to operator actuation of the pilot valve 36A except insofar as the flow control valve 72 does not pass fluid, not needed by the associated motor 16A, into a bypass line leading to a subsequent motor flow control valve. This is unnecessary in the FIG. 3 modification as the flow control valve 72 for all motors in the parallel system connect directly with the pump output line 22A.

In both forms of the circuit depicted in FIGS. 2 and 3, inlet passage 42A of resolver valve 41A receives a pressure which increases and decreases in correspondence with increases and decreases of the pressure within the motor 16A. Referring again to FIG. 1, the resolver valve 41A transmits this pressure to the inlet 43A of resolver valve 40A except at such times as a higher pressure is being received through the other inlet 43A of resolver valve 41A in which case that higher pressure is transmitted to resolver valve 40A.

Referring still to FIG. 1, each of the additional resolver valves 40A and 39A of the first circuit 13A similarly compare the pressures being received at inlets 42A and 43A and transmit the higher pressure to the next resolver valve except that the initial resolver valve 39A transmits the highest received pressure to pump control 19A.

Thus the resolver valves 39A, 40A and 41A of the first circuit 13A continually compare the pressures within a predetermined group of devices, motors 14A, 15A, 16A, that may be receiving fluid from pump 18A and transmit the highest of these pressures to pump control 19A. Pump control 19A responds by adjusting the displacement of pump 18A to match output pressure to that within the most highly pressurized one of the motors 14A, 15A, 16A and to match output flow with the totalized demand from the several motors.

The resolver valves 39B, 40B and 41B of the second circuit 13B similarly compare pressures from a predetermined group of devices, motors 14B, 15B and 16B, and transmit a control pressure to the second pump control 19B, from the most highly pressurized motor, to adjust the displacement of second pump 18B in a similar manner.

The composition of the predetermined group of devices or motors from which pressures are compared to obtain control pressure for the first pump control 19A changes when pilot valve 36B of the second circuit 13B is shifted to actuate motor 16B and to supply pilot pressure to line 56B. Second resolver control valve 51B then shifts to transmit motor line pressure from motor 16B to the second inlet 43A of resolver valve 41A of the first circuit 13A. The predetermined group of devices from which pressures are compared to obtain a control pressure for first pump control 19A now includes motor 16B of the second circuit 13B as well as the motors 14A, 15A and 16A of the first circuit itself. This is desirable since second circuit motor 16B may receive working fluid from the first circuit 13A through crossover line 17A and may at times be the most highly pressurized device being supplied with fluid by the first circuit pump 18A.

Thus if the second circuit motor 16B is operating wholly or in part with working fluid received from the first circuit 13A through line 17A, pump control 19A of the first circuit receives a control pressure corresponding to the pressure in the second circuit motor 16B at such times as that pressure is higher than the pressures in any of the motors 14A, 15A and 16A of the first circuit 13A itself.

Essentially similar operation occurs with respect to controlling the pump 18B of the second circuit 13B. Resolver control valve pilot line 52A is not pressurized and resolver control valve 51A vents the second inlet 43B of resolver valve 41B of the second circuit except when motor 16A of the first circuit is operating in one predetermined direction as previously described. Accordingly, when motor 16A is not operating in the predetermined direction, resolving means 38B compares only the pressures for motors 14B, 15B and 16B of the second circuit to obtain a control pressure for second circuit pump control 19B.

If motor 16A of the first circuit 13A is then actuated to operate in the predetermined direction, first resolver control valve 51A is piloted to transmit motor line pressure from the first circuit motor 16A to inlet 43B of resolver valve 41B of the second circuit 13B. Thus the predetermined group of devices from which pressures are compared to obtain a control pressure for second circuit pump control 19B is temporarily extended to include a motor 16A of the first circuit 13A.

Accordingly, when the pump 18A or 18B of either fluid circuit 13A or 13B is supplying fluid only to the motors of that particular circuit, the control pressure for the pump control 19A or 19B of that particular circuit matches the most highly pressurized one of the motors of that circuit. At other times, when fluid from the pump 18A or 18B of either circuit is also being utilized by a device or motor 16A or 16B of the other circuit, the control pressure for each circuit may be derived from a device of the other circuit when that device is more highly pressurized.

The intercommunication of either pump control 19A or 19B with the most highly pressurized one of a predetermined group of devices, the composition of which group may be different at different stages of operation, is always a two way or reversible flow path through the pressure comparing means 38A or 38B. Thus the control signal lines 21A and 21B do not require a continuous bleed of fluid through orifices in order to track pressure decreases. As a result the pump controls 19A and 19B respond quickly and precisely to decreases of control pressure as well as to increases of pressure at the most highly pressurized device. Power waste, from continually pumping high pressure fluid through a bleed orifice, is thereby avoided. As the demand for fluid from the pumps 18A and 18B is reduced by the absence of bleed orifices, in some cases pumps 18A and 18B, the power source and other components of the fluid system 11 may be of smaller capacity then would otherwise be required.

The fluid system 11 as described above for purposes of example is one in which underutilized pumping capacity at either of the two component circuits 13A and 13B is made available to the other circuit under predetermined operating conditions. The invention may also be employed in fluid systems in which only a one way working fluid sharing function is needed. For example, the system 11 may be converted to one in which output capacity of the second pump 18B that is not being utilized by the second circuit 13B is made available to the first circuit 13A but in which no reverse transfer of fluid from first circuit 13A to second circuit 13B is provided for. This may be accomplished by eliminating the first crossover line 17A, the second control pressure transmitting line 53B and first resolver control valve 51B and pressure transmitting line 54B. The second outlet 43A of resolver valve 41A of the first circuit 13A may then be vented to drain or the resolver valve 41A may simply be removed entirely with second inlet 43A of the preceding resolver valve 40A being connected to signal line 66 of motor control valve 34A.

In the embodiments herein described, a crossover of working fluid from one circuit 13A or 13B to the other and a comparison of load signals from both circuits occurs only during operation of motor 16A or 16B in one of the two different directions of motor operation. In embodiments of this kind, resolver control valves 51A and 51B conserve power by preventing an unnecessarily high control pressure from reaching pump control 19A or 19B during periods when motor operation is in the opposite direction and no actual crossover of working fluid is occuring. In instances where it is desired that sharing of fluid between circuits 13A and 13B occur regardless of the direction of motor operation, resolver control valves 51A and 51B may be eliminated as described above.

Other aspects, objects and advantages of this invention can be obtained from a study of the drawings, the disclosure and the appended claims.

I claim:

1. In a fluid system (11) having first (14A, 15A, 16A) and second (14B, 15B, 16B) pluralities of fluid operated devices, first (12A) and second (12B) fluid source means for supplying working fluid to said first (14A, 15A, 16A) and second (14B, 15B, 16B) pluralities of fluid operated devices respectively, first (19A) and second (19B) control means for varying the outputs of said first (12A) and second (12B) fluid source means, respectively, in response to control pressures, and crossover means (17) for transmitting fluid from said first source means (12A) to at least one device (16B) of said second plurality of devices (14B, 15B, 16B), the improvement comprising:

first pressure comparing means (38A) for establishing a two way control pressure flow path between said first control means (12A) and the one of a first predetermined group (14A, 15A, 16A, 16B) of said devices that is most highly pressurized at a particular time, said first predetermined group (14A, 15A,

16A, 16B) including said first plurality of devices (14A, 15A, 16A) and at least said one (16B) of said second plurality of devices (14B, 15B, 16B).

2. A fluid system (11) as set forth in claim 1 wherein said second fluid source means (12B) includes control valve means (34B) for controlling the flow of working fluid to said one device (16B) of said predetermined group of devices (14B, 15B, 16B, 16A) and resolver control means (46) for communicating said one device (16B) with said first pressure comparing means (38A) while said control valve means (34B) is directing fluid to said one device (16B) and for blocking communication between said one device (16B) and said first pressure comparing means (38A) while said control valve means (34B) is blocking fluid flow to said one device (16B).

3. A fluid system (11) as set forth in claim 2, wherein said first pressure comparing means (38A) includes a plurality of sequentially connected resolver valves (39A, 40A, 41A) including an initial resolver valve (39A) and a final resolver valve (41A), each having a pair of inlet passages (42A, 43A) and an outlet passage (44A), one inlet passage (42A) of each of said resolver valves (39A, 40A, 41A) being communicated with an associated separate one of said first plurality of fluid driven devices (14A, 15A, 16A) and the other inlet passage (43A) of each of said resolver valves (39A, 40A) except said final one (41A) thereof being communicated with said outlet passage (44A) of the next thereof, said outlet passage (44A) of said initial one (39A) of said resolver valves (39A, 40A, 41A) being communicated with said first control means (19A), and wherein said resolver control means (46) communicates said other inlet passage (43A) of said final resolver valve (41A) with said one (16B) of said devices of said second circuit (13B) during periods when said crossover means (17) is transmitting fluid from said first circuit (13A) to said one device (16B) of said second circuit (13B).

4. The fluid system (11) as set forth in claim 3 wherein said control valve means (34B) delivers a flow of fluid from said first and second source means (12A, 12B) to said one device (16B) of said second plurality of devices (14B, 15B, 16B), and said resolver control means (46) includes first resolver control valve means (51B) for communicating said one device (16B) and said final resolver valve (41A) in response to delivery of said flow of fluid to said one device (16B) by said control valve means (34B).

5. A fluid system (11) as set forth in claim 3 wherein said resolver control means (46) vents said other inlet passage (43A) of said final resolver valve (41A) when said one device (16B) of said second circuit (13B) is not operating.

6. A fluid system (11) as set forth in claim 1 wherein said crossover means (17) also transmits fluid from said second source means (12B) to at least one device (16A) of said first plurality of devices (14A, 15A, 16A), further including second pressure comparing means (38B) for establishing a two way control pressure flow path between said second control means (19B) and the one of a second predetermined group (14B, 15B, 16B, 16A) of said devices that is most highly pressurized at a particular time, said second predetermined group (14B, 15B, 16B, 16A) including said second plurality of devices (14B, 15B, 16B) and at least one (16A) of said first plurality of devices (14A, 15A, 16A).

7. A fluid system (11) as set forth in claim 6 including first control valve means (34A) for selectively directing fluid to said one device (16A) of said first predetermined group of devices (14A, 15A, 16A), second control valve means (34B) for selectively directing fluid to said one device (16B) of said second predetermined group of said devices (14B, 15B, 16B, 16A), means (51B) for blocking communication between said one device (16B) of said first predetermined group and said first pressure comparing means (38A) except while said second control valve means (34B) is directing fluid to said one device (16B) of said first predetermined group of devices (14A, 15A, 16A, 16B), and means (51A) for blocking communication between said one device (16A) of said second predetermined group of devices (14B, 15B, 16B, 16A) and said second pressure comparing means (38B) except while said first control valve means (34A) is directing fluid to said one device (16A) of said second predetermined group of devices (14B, 15B, 16B, 16A).

8. A fluid system (11) comprising:

a first pressurized fluid source (12A) having first control means (19A) for varying output pressure in response to variations of a control pressure, a first plurality of fluid motors (14A, 15A, 16A), a first plurality of motor control valves (23A, 29A, 34A) each being connected between said first fluid source (12A) and an associated individual one of said first plurality of motors (14A, 15A, 16A), a second pressurized fluid source (12B) having second control means (19B) for varying output pressure in response to variations of a control pressure, a second plurality of fluid motors (14B, 15B, 16B), a second plurality of motor control valves (23B, 29B, 34B) each being connected between said second fluid source (12B) and an associated individual one of said second plurality of motors (23B, 29B, 34B), crossover means (17) for transmitting fluid supplied by said first source (12A) to at least one of said motor control valves (23B, 29B, 34B) of said second plurality thereof, and resolver means (38A) for intercommunicating said first control means (19A) with the most highly pressurized one of a group of said motors which includes said motors (14A, 15A, 16A) of said first plurality thereof and which further includes, at least during periods when said crossover means (17) is transmitting fluid, at least one of said motors (14B, 15B, 16B) of said second plurality thereof.

9. A fluid system (11) as set forth in claim 8 wherein said resolver means (38A) includes a first plurality of resolver valves (39A, 40A, 41A) including an initial one (39A) and a final one (41A) thereof, each of said first plurality of resolver valves (39A, 40A, 41A) having a pair of inlet passages (42A, 43A) and an outlet passage (44A), one inlet passage (42A) of each of said first plurality of resolver valves (39A, 40A, 41A) being connected to an associated individual one of said first plurality of motors (14A, 15A, 16A) and the other inlet passage (43A) of each of said first plurality of resolver valves (39A, 40A) other than said final one (41A) thereof being connected to said outlet (44A) of a subsequent one thereof, said outlet (44A) of said initial one (39A) of said first plurality of resolver valves (39A, 40A, 41A) being connected to said first control means (19A) and means (51B) for communicating said other inlet passage (43A) of said final one (41A) of said first plurality of resolver valves (39A, 40A, 41A) with said one of said motors (14B, 15B, 16B) of said second plurality thereof at least while said crossover means (17) is transmitting fluid to said one of said motors (14B, 15B, 16B) of said second plurality thereof.

10. A fluid system as set forth in claim 9 wherein said means (51B) blocks said communication between said other inlet passage (43A) of said final one (41A) of said first plurality of resolver valves (39A, 40A, 41A) and said one of said second plurality of motors (14B, 15B, 16B) except when said one of said second plurality of motor control valves (23B, 29B, 34B) is receiving fluid through said crossover means (17).

11. A fluid system (11) as set forth in claim 10 wherein said means (51B) vents said other inlet passage (43A) of said final one (41A) of said first plurality of resolver valves (39A, 40A, 41A) except when said crossover means (17) is transmitting fluid to said one of said second plurality of motor control valves (23B, 29B, 34B).

12. A fluid system (11) as set forth in claim 8 wherein said crossover means (17) also transmits fluid supplied by said second source (12B) to at least one of said motor control valves (23A, 29A, 34A) of said first plurality thereof and further including second resolver means (38B) for intercommunicating said second control means (19B) with the most highly pressurized one of a second group of said motors that includes said motors (14B, 15B, 16B) of said second plurality thereof and further includes at least one of said first plurality of motors (14A, 15A, 16A) when said one of said first plurality of motors (14A, 15A, 16A) is receiving fluid through said crossover means (17).

* * * * *